US009140150B2

(12) United States Patent
Boesel

(10) Patent No.: US 9,140,150 B2
(45) Date of Patent: Sep. 22, 2015

(54) CAMSHAFT PHASER

(75) Inventor: Christian Boesel, Rednitzhembach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/985,165

(22) PCT Filed: Dec. 12, 2011

(86) PCT No.: PCT/EP2011/072467
§ 371 (c)(1),
(2), (4) Date: Aug. 13, 2013

(87) PCT Pub. No.: WO2012/113474
PCT Pub. Date: Aug. 30, 2012

(65) Prior Publication Data

US 2013/0312684 A1 Nov. 28, 2013

(30) Foreign Application Priority Data

Feb. 23, 2011 (DE) ..... 10 2011 004 588

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34483* (2013.01)

(58) Field of Classification Search
USPC ..... 123/90.15, 90.17
See application file for complete search history.

(56) References Cited

U.S. PATENT DOCUMENTS

| | | | | |
|---|---|---|---|---|
| 5,337,711 | A * | 8/1994 | Hampton | 123/90.17 |
| 6,619,248 | B1 * | 9/2003 | Bertelshofer et al. | 123/90.15 |
| 8,375,906 | B2 * | 2/2013 | Myers et al. | 123/90.17 |
| 2008/0047513 | A1 * | 2/2008 | Schafer et al. | 123/90.17 |
| 2010/0075765 | A1 * | 3/2010 | Isenberg et al. | 464/160 |
| 2011/0120399 | A1 * | 5/2011 | Weber | 123/90.15 |
| 2012/0291735 | A1 * | 11/2012 | Wagner et al. | 123/90.17 |
| 2013/0019829 | A1 * | 1/2013 | Weber | 123/90.17 |
| 2013/0055975 | A1 * | 3/2013 | Bosel | 123/90.15 |
| 2013/0327288 | A1 * | 12/2013 | Boese | 123/90.17 |

FOREIGN PATENT DOCUMENTS

| | | | |
|---|---|---|---|
| CN | 101963174 | | 2/2011 |
| DE | 10 2007 039 282 | | 2/2009 |
| DE | 102007039282 | A1 * | 2/2009 |
| DE | 10 2008 051142 | | 4/2010 |
| JP | 0444511 | | 4/1992 |

* cited by examiner

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A camshaft phaser (1), having a drive element (2), an output element (3), and a cover element (4), the cover element (4) being joined in latching-type, form-locking engagement with the drive element or output element (2, 3), and the cover element (4) having play-eliminator that eliminates a play in the connection.

7 Claims, 5 Drawing Sheets

CAMSHAFT PHASER

BACKGROUND

Camshaft phasers are used in combustion engines to vary the valve timing of the combustion chamber valves to be able to variably construct the phase relationship between the crankshaft and camshaft within a defined angular range between a maximum advanced and a maximum retarded position. Consumption and emissions are reduced by adapting the valve timing to the actual load. For this purpose, camshaft phasers are integrated in a drive train via which a torque is transmitted from the crankshaft to the camshaft. This drive train can be realized as a belt, chain or gear drive, for example.

In the case of a hydraulic camshaft phaser, the output element and the drive element form one or a plurality of pairs of pressure chambers which act in mutual opposition and can be pressurized by oil. In this case, the drive element and the output element are coaxially configured. A relative movement between the drive element and the output element is generated in response to the filling and emptying of individual pressure chambers. The spring acting rotationally between the drive element and the output element impels the drive element in an advantageous direction relative to the output element. This advantageous direction can be co-rotational or counter-rotational to the direction of rotation.

One common type of hydraulic camshaft phaser is the vane-type adjuster. Vane-type adjusters have a stator, a rotor and a drive element. The rotor is mostly nonrotatably connected to the camshaft and forms the output element. The stator and the drive element are likewise nonrotatably interconnected and are also optionally formed in one piece. The rotor is disposed coaxially to and within the stator. Via the radially extending vanes thereof, the rotor and stator form oil chambers which act in mutual opposition, can be pressurized by oil, and which make possible a relative movement between the stator and rotor. In addition, the vane-type adjusters have various sealing covers. The stator, drive element and sealing cover are secured by a plurality of screw connections.

Another known type of hydraulic camshaft phaser is the axial piston adjuster. In this case, oil pressure axially displaces a slide element which, via helical toothing, generates a relative rotation between a drive element and an output element.

Another type of camshaft phaser is the electromechanical camshaft phaser which has a three-shaft gear system (for example, a planetary gear system). One of the shafts forms the drive element, and a second shaft, the output element. Rotational energy can be supplied via the third shaft to the system by an actuator, for example, an electromotor or a brake, or removed therefrom. A spring can likewise be configured to support or return the drive element and the output element during the relative rotation thereof.

The German Patent Application DE 10 2007 039 282 A1 describes a vane-type adjuster having a belt pulley for driving the camshaft phaser, and having a plastic part, a fluid-tight space being formed by the connection of the two components. The connection is realized by latching tabs in circumferential elongated holes and provides a form-locking in the axial direction. However, since the undercuts of the latching tabs can become loose in operation, wedge elements are introduced that are intended to prevent the latching tabs from springing back. These wedge elements safeguard the form-locking engagement and ensure that it can no longer become loose during operation.

SUMMARY OF THE INVENTION

It is an object of the present invention to provide a camshaft phaser whose service life will be prolonged and reliability enhanced.

The present invention provides that play-elimination means, which are formed in one piece with the cover element and whose direction of extension is the axial direction of the camshaft phaser, eliminate the tolerance-induced play present in the form-locking connection. On the one hand, form-locking connections are very economical because there is no need for additional components or for testing the same. On the other hand, form-locking connections have play that is eliminated here in accordance with the present invention, thereby avoiding impact forces in the connection excited by vibrations during operation. During operation, the clearance existing between the connection partners due to the play is crossed by the amplitudes of the vibrations, resulting in an undamped pulse in the contact of both connection partners. This adversely affects the acoustic behavior and the service life of the components. By eliminating this play and thereby the eliminating the effects of undamped pulses, an enhanced reliability is achieved, as a permanently fixed seating of the cover element is provided. The play-elimination means are advantageously integrally co-formed in one piece on the cover element since the cover element is mostly made of simple and low-cost plastic.

In one embodiment of the present invention, the cover element has a guide pin that is integrally co-formed in one piece. The guide pin has the task of centering the cover element during the joining process and of facilitating the process in terms of positioning. The guide pin advantageously has play-elimination means that are formed in this case as a local raised portion. This local raised portion is partially configured on the circumference of the guide pin. It extends axially along the outer surface of the guide pin and in parallel to the axis thereof. During the joining process, the centering portion of the guide pin first engages with the complementary receiving recess of the connection partner, a centering taking place. In response to continuation of the joining process, the local raised portion overlaps with the complementary receiving recess where it is plastically deformed by the same. In this context, a material overlapping must ideally prevail between the local raised portion and the complementary receiving recess to ensure that material of the play-elimination means configured as a local raised portion is displaced, thereby closing the play-induced clearance. At the least, the material overlap should be greater, respectively equal to zero, respectively at least contact should prevail to ensure that the play-elimination means is effective. A flow of the material is attained in the area of the local raised portion, which resembles a type of compressive rib. Alternatively, the complementary receiving recess on the drive, respectively output element, may plastically deform.

One advantageous embodiment provides that the local raised portion on the guide pin of the cover element be oriented circumferentially. This makes it possible for manufacturing-induced tolerances to be advantageously compensated during the assembly operation. The local raised portion is to be preferably oriented in the circumferential direction, as play also is also present circumferentially due to the configuration of the latching-type form-locking. During operation, the different expansion coefficients of the materials of the connection partners subject the cover element to tension since it is made of plastic, whereas the drive element or output element is made of metallic materials. The particular local raised portions on different guide pins may be configured on alternate sides to eliminate the circumferential play.

In one especially preferred embodiment, the play-elimination means is configured as a local raised portion on the cover element, but is not formed on the guide pin. Rather, upon manufacturing of the form-locking connection, this raised portion forms an abutment in the form of a local bulging of material in the axial direction, thus is predominantly shaped in the joining direction. To this end, the raised portion is configured at a defined, circumferential clearance to the connection point to form a two-sided form-locking connection from a one-sided form-locking connection under a pretensioning in the direction of action of the form-locking connection, thereby likewise eliminating play in the connection by bending the cover element. Alternatively, the abutment may feature a predominantly radial clearance to the form-locking connection, whereby the cover element is self-tensioned. To this end, the abutment may have a smaller clearance to the middle of the cover element than the form-locking connection, formed by a latching tab and a complementary opening.

One embodiment of the present invention provides that the cover element have a softer material than the drive or output element to which it is connected, at least for the area of the plastic deformation of the play-elimination means. It is known for the drive element or the output element to be made of a higher-quality material (for example, steel) to be able to withstand the stresses and strains. In contrast, for a function of the plastic deformation of the play-elimination means, the cover element should feature a material that is readily flowable under the influence of force. Such materials are preferably plastics (also fiber-reinforced) or nonferrous metals.

The play-elimination means formed as local raised portions may optionally be located on the drive element or the output element instead of the cover element. In this case, the play-elimination means of the cover element, which are integrally co-formed in one piece, are the complementary receiving recesses that may plastically deform either on the cover element or on the drive element or output element.

In another embodiment of the present invention, the cover element is configured as a spring cover that secures the restoring spring, which is configured for tensioning the drive element and output element, preventing loss thereof. This securing means is mostly configured in the axial direction in that the spring cover seals the spring cavity that is open at the front end.

In one embodiment of the present invention, the form-locking is provided by a latching connection. A one-sided form-locking is produced by latching tabs and complementary openings, the latching tabs featuring an undercut which engages in the joining direction behind the complementary opening. The latching tabs feature the play-elimination means, which enable them to also remain pretensioned in the radial direction and thereby eliminate a radial play, as well as eliminate an axial and circumferential play following manufacture of the form-locking connection.

Alternatively, in configuring the latching tabs for eliminating radial play, the local raised portions in accordance with the present invention may be utilized in one piece together with the play-elimination means that are integrally formed in one piece with the latching tabs. This relieves the latching tabs and prolongs service life. To this end, play-elimination means integrally formed in one piece on the latching tabs may also be oriented circumferentially or in the axial direction; following the joining process, the play-elimination means is either used as an abutment or squeezed in the forming of the compressive rib.

The play-elimination means in accordance with the present invention on the cover element or on the output element or drive element make it possible for the positive connection to be configured to be play-free, thereby prolonging the service life of the components. The present invention provides a multiplicity of possible embodiments that may be combined with one another, the goal being to eliminate the play that is inherent in the manufacturing during operation as well, thereby ensuring that the reliability of the cover element is retained.

BRIEF DESCRIPTION OF THE DRAWINGS

Exemplary embodiments of the present invention are illustrated in the figures, which show.

DETAILED DESCRIPTION

Figure 1:
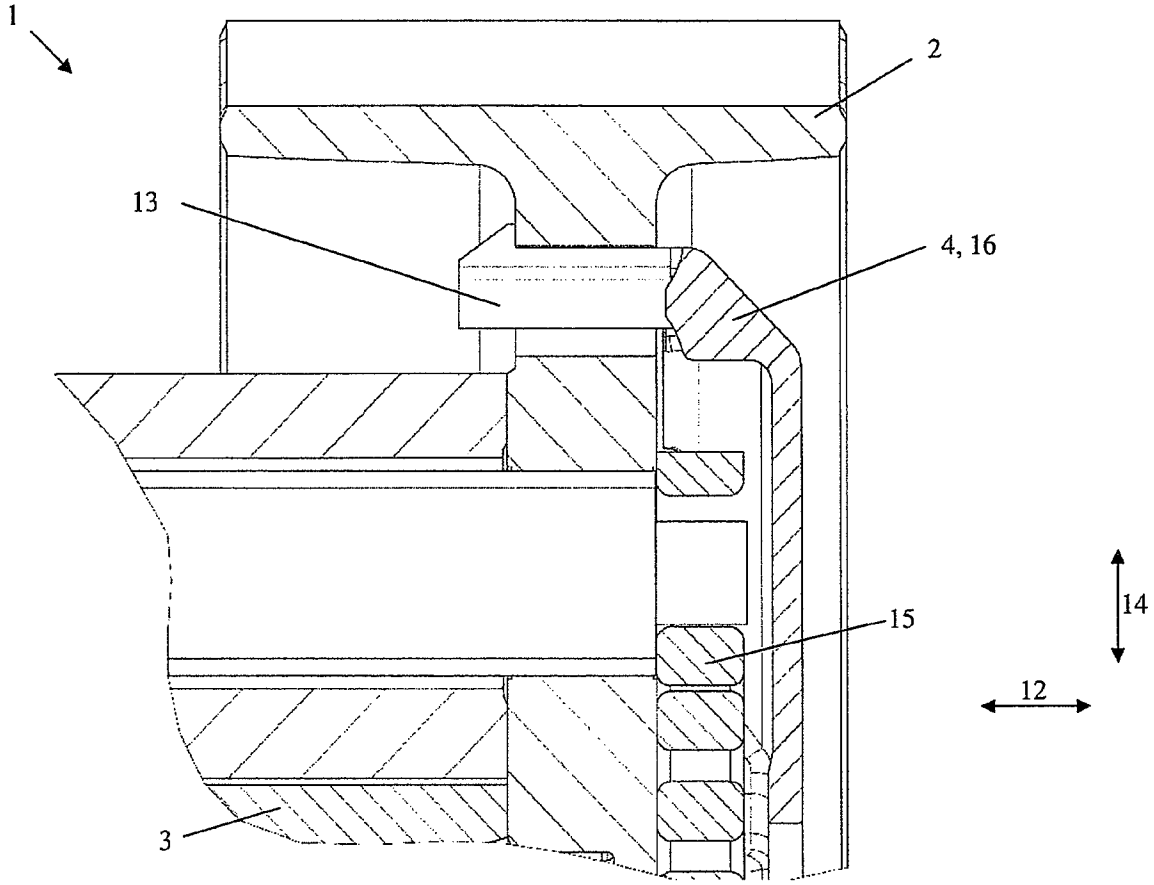
FIG. 1 a latching-type form-locking connection of a cover element having a drive wheel of a camshaft phaser.

FIG. 1 shows a part sectional view of a longitudinal section through a camshaft phaser 1. Camshaft phaser 1 has a drive element 2, an output element 3, a spring cover 16 and a spring 15. The basic design and the operation of a camshaft phaser are sufficiently known to one skilled in the art. Therefore, there is no need for a further description of the same here.

In accordance with the present invention, spring cover 16 is configured as cover element 4; further details pertaining to the configuration and the action of the play-elimination means, which are integrally co-formed in one piece with cover element 4, being first provided in the further figures. Cover element 4 features a latching tab 13 that engages with a complementary opening of drive wheel 2. In and of itself, latching tab 13 represents a one-sided interlocking engagement in axial direction 12. In this context, latching tab 13 engages behind drive element via a barb-like portion. The play existing in radial direction 14 between latching tab 13 and drive element 2 is due to the manufacturing tolerances and the different coefficients of expansion of the two connection partners. In FIG. 1, cover element 4 has axial, as well as radial play with the latched form-locking connection.

Figure 2:
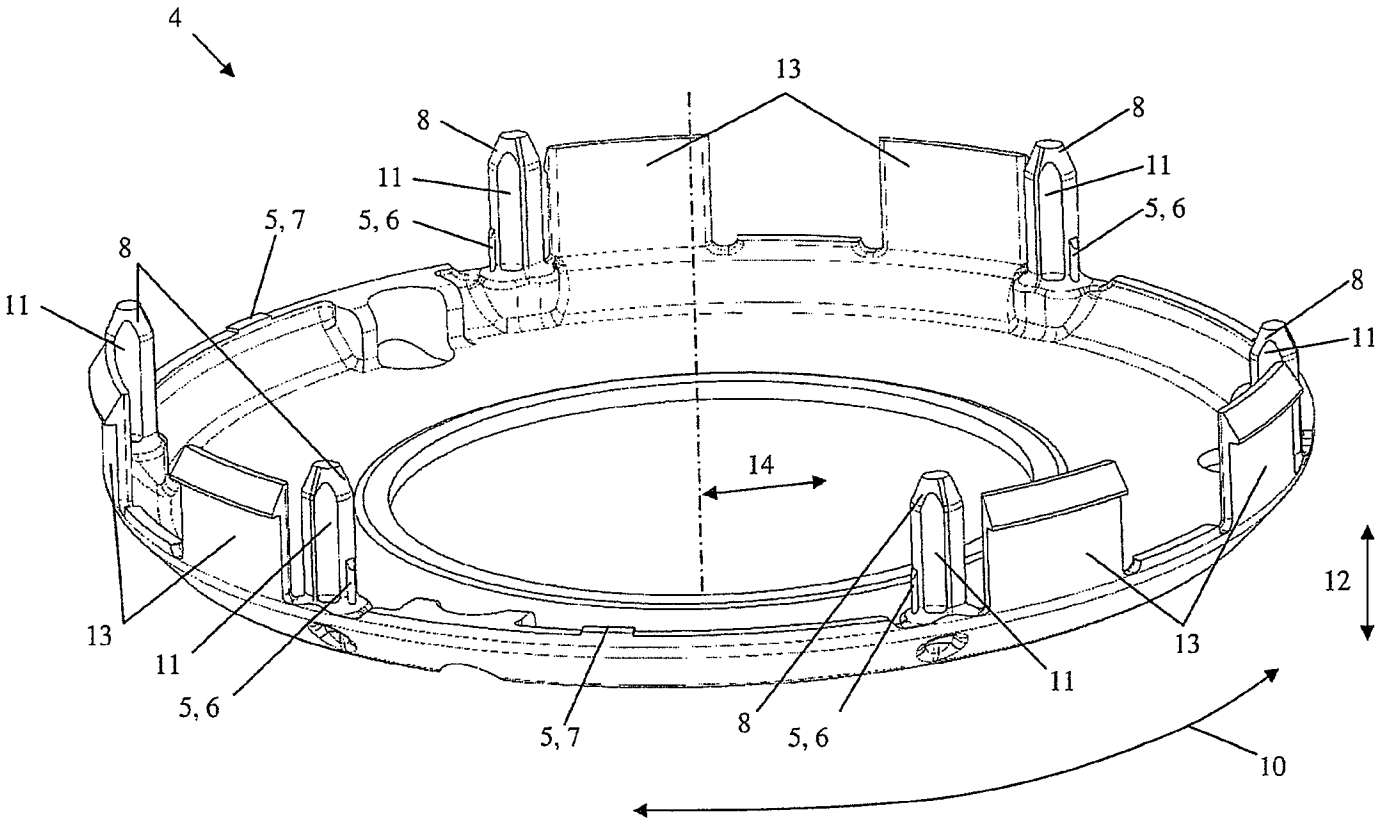
FIG. 2 a cover element having the play-eliminations means according to the present invention.

FIG. 2 shows a cover element 4 having a plurality of latching tabs 13 distributed in circumferential direction 10. These latching tabs 13 may be brought into engagement with complementary openings on a drive element 2 or an output element 3. In addition, a plurality of guide pins 11 are configured in circumferential direction 10 which, in the same way as latching tabs 13, are integrally formed in one piece with cover element 4. To ensure that cover element 4 is reliably joined to a connection partner, guide pins 11 have a centering region 8 at the unattached end thereof. The unattached ends of guide pins 11 having respective centering regions 8 project beyond latching tabs 13 in axial direction 12. Guide pins 11 feature at least one play-eliminations means 5 according to the present invention in the form of a local raised portion configured partially on the circumference that extends predominantly axially, extends locally beyond the circumference of guide pin 11, and is oriented in circumferential direction 10. Moreover, cover element 4 has a plurality of play-elimination means 5 in the form of rectangular raised portions configured in circumferential direction 10. These rectangular raised portions act as an, abutment 7 according to the present invention upon the latching-type joining of latching tabs 13 with a complementary opening. Abutments 7 extend by the longer side edge of the rectangular shape thereof predominantly in circumferential direction 10. The extent of abutment 7 in radial direction 14 is limited by the outer and inner edge of the rim of pot-shaped cover element 4. Abutment 7 bridges the axial play between the cover element and the connection partner thereof in axial direction 12 by the extent thereof, thereby functioning as a counter support. Further details pertaining to the more precise operation of abutment 7 are provided in FIG. 5.

Figure 3:
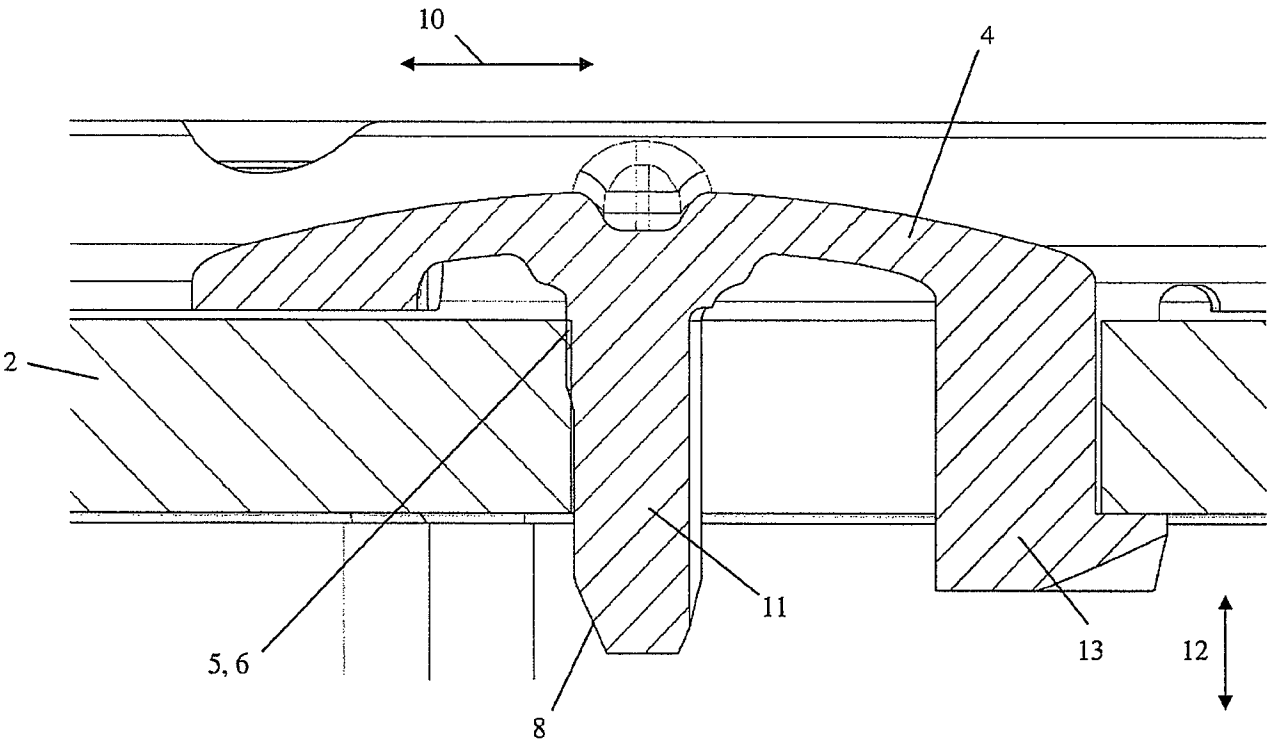
FIG. 3 a section through the cover element in a view of the configuration and the action of the play-elimination means of the guide pin.

To clarify the operation of play-elimination means 5 of guide pin 11, FIG. 3 shows a more detailed section through camshaft phaser 1.

Discernible is guide pin 11 which passes through the respective complementary opening thereof. Centering region 8 is configured at the unattached end of guide pin 11. Guide pin 11 itself is cylindrical, centering region 8 having a conical form. Located in the area of the base of guide pin 11, which is integrally formed in one piece on cover element 4, is play-elimination means 5 formed as local raised portion 6, whose main direction of extension is axial direction 12. The raised portion in circumferential direction 10 is equal to or greater than the play prevailing between guide pin 11 and the respective complementary opening thereof in circumferential direction 10. Upon joining of guide pin 11 together with cover element 4 and latching tabs 13, local raised portion 6 is already squeezed before latching tab 13 is latched into place. Local raised portion 6 has a ramp-type construction in axial direction 12 to facilitate the joining process. With respect to the dimensions thereof above the outer surface, local raised portion 6 remains substantially constant along axial direction 12. Alternatively, non-linear shapes of local raised portion 6 in axial direction 12 may be provided here.

Figure 4:
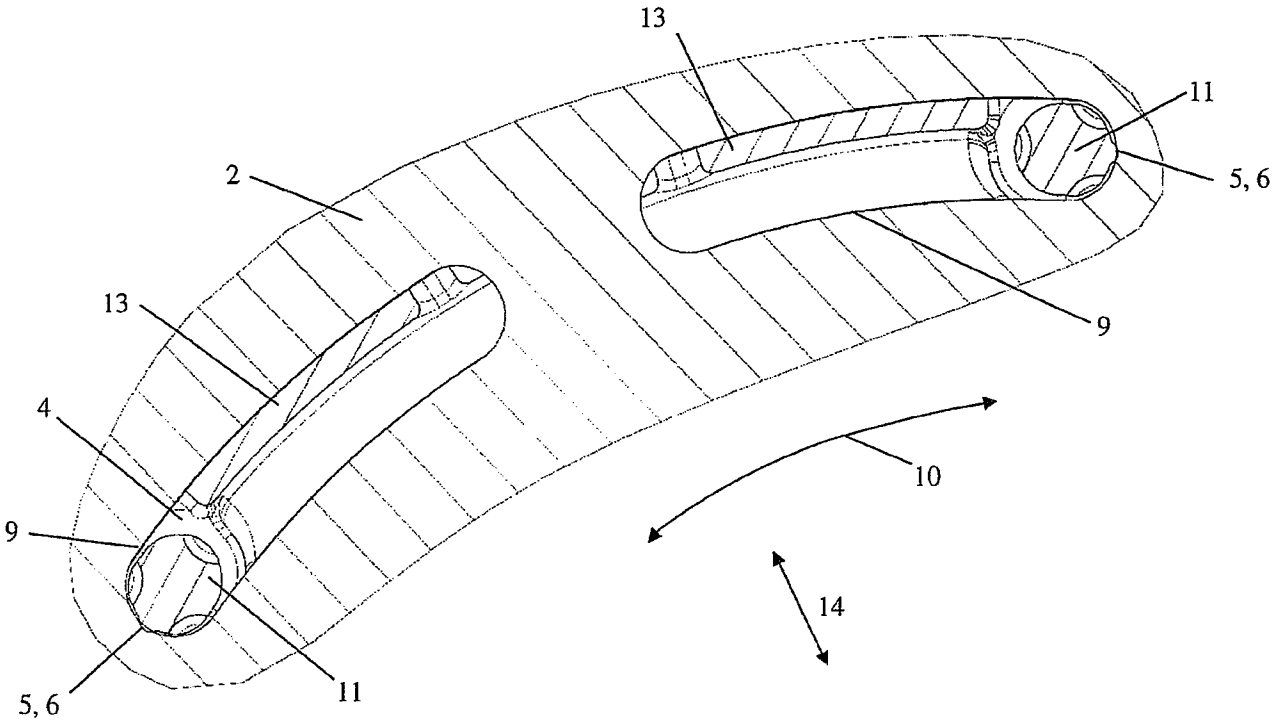
FIG. 4 a further section through the cover element in a view of the configuration and the action of the play-elimination means of the guide pin.

FIG. 4 shows a detailed section through two adjacent latching tabs 13 having two adjacent guide pins 11 that feature local raised portions 6 according to the present invention in circumferential direction 10. It is readily discernible that cover element 4 is clamped by the two-way orientation of local raised portions 6 on the two guide pins 11 circumferentially in both directions. A play elimination in radial direction 14 is also realized by local raised portions 6 since the contour of complementary receiving recess 9 of the outer surface of guide pin 11 is substantially constant. The initial overlapping of the two contours of local raised portion 6 and complementary receiving recess 9 ends in a squeezing; i.e., a flowing of the material of play-elimination means 5. In response to different thermal expansion of cover element 5 and the connection partner, the freedom from play is retained.

Figure 5:
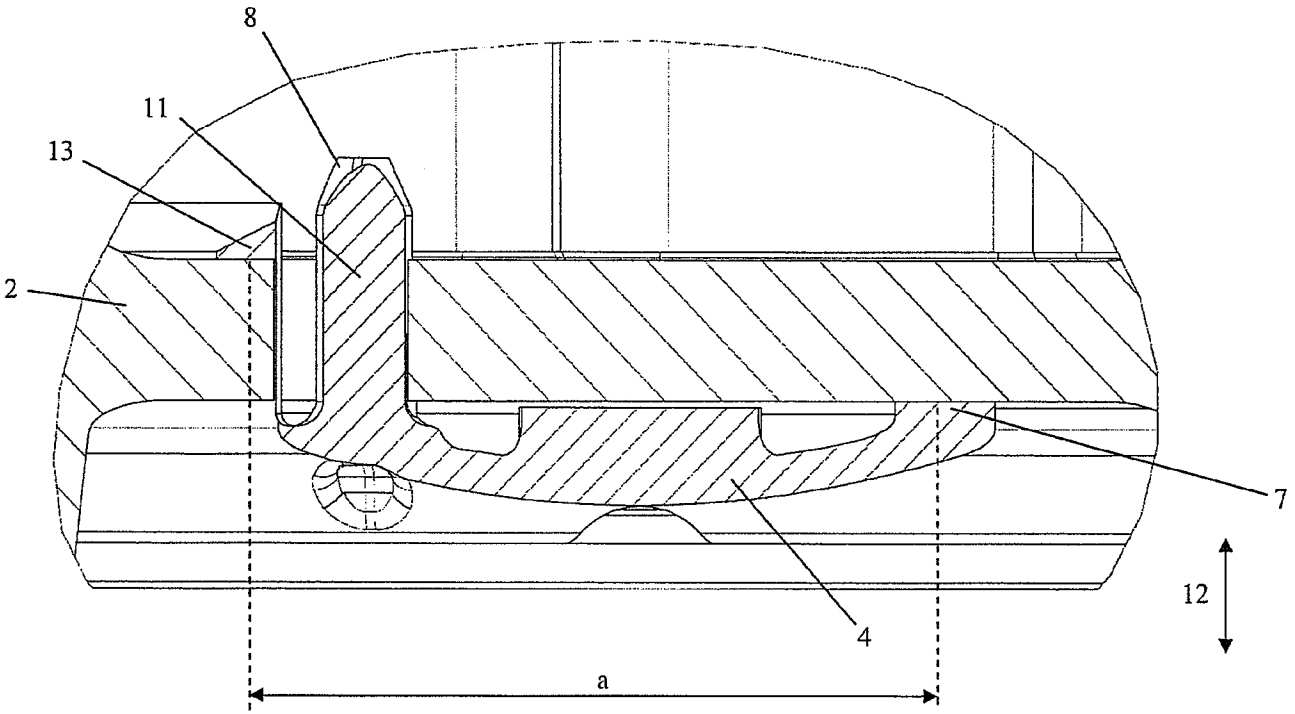
FIG. 5 a section through the cover element in a view of the configuration and the action of the play-elimination means configured as an abutment.

FIG. 5 shows a detailed section through cover element 4 and abutment 7, guide pin 11 and latching tab 13, as well as drive element 2. In the unassembled state, the clearance between the functional planes of abutment 7 and latching tab 13 is smaller than the thickness of drive element 2 and the opening that is complementary to latching tab 13. Already prior to the form-locking engagement of latching tab 13 with drive element 2, abutment 7 of cover element 4 comes in contact with drive element 2 in axial direction 12 during the joining process. In response to barb-like portion of latching tab 13 snapping in, a bending moment is applied to cover element 4 by clearance a between latching tab 13 and abutment 7. The bending moment subjects cover element 4 to pretensioning, thereby eliminating the manufacturing- and operation-induced play.

LIST OF REFERENCE NUMERALS

1) camshaft phaser
2) drive element
3) output element
4) cover element
5) play-elimination means
6) local raised portion
7) abutment
8) centering portion
9) complementary receiving recess
10) circumferential direction
11) guide pin
12) axial direction
13) latching noses
14) radial direction
15) spring
16) spring cover

What is claimed is:

1. A camshaft phaser comprising:
a drive element;
an output element; and
a cover element;
the drive element and the output element being rotatable relative to one another;
the cover element being joined in a latching, form-locking engagement with the drive element or the output element in an axial direction;
the cover element being formed together with a play-eliminator integrally co-formed in one piece with the cover element, the play-eliminator extending in the axial direction,
wherein the play-eliminator is formed as a local raised portion of a guide pin integrally co-formed in one piece with the cover element, and
wherein the local raised portion of the guide pin is oriented in a circumferential direction of the camshaft phaser, and play in the circumferential direction is eliminated by plastic deformation.

2. The camshaft phaser as recited in claim 1 wherein the local raised portion of the guide pin cooperates with a complementary receiving recess on the drive element or on the output element in such a way that, upon joining of the cover element with the drive element or the output element, the local raised portion is plastically deformed.

3. The camshaft phaser as recited in claim 1 wherein the guide pin includes a centering portion for joining of the cover element to the drive element or the output element.

4. The camshaft phaser as recited in claim 1 wherein the play eliminator is integrally co-formed in one piece as an abutment on the cover element, the abutment extending in the axial direction, and upon the latching of the cover element with the drive element or the output element, the abutment has an elastic clamping effect in a joining direction.

5. The camshaft phaser as recited in claim 1 wherein the cover element is made of a softer material than the drive element or the output element.

6. The camshaft phaser as recited in claim 1 wherein the cover element is a spring cover axially securing a spring.

7. The camshaft phaser as recited in claim 1 wherein the latching, form-locking engagement is formed by latching tabs having complementary openings, the latching tabs including the play eliminator in such a way that, following a joining process, the latching tabs are pretensioned in a radial direction in such a way that a freedom from play exists in the form-locking engagement.

* * * * *